US009034777B2

(12) United States Patent
Hines et al.

(10) Patent No.: US 9,034,777 B2
(45) Date of Patent: May 19, 2015

(54) FIRE RESISTANT WOVEN FABRICS AND GARMENTS

(75) Inventors: Robert Winfred Hines, Columbus, GA (US); James Jonathan Bailey, Fortson, GA (US); Leslie Gene Cone, Columbus, GA (US)

(73) Assignee: DRIFIRE, LLC, Columbus, GA (US)

( * ) Notice: Subject to any disclaimer, the term of this patent is extended or adjusted under 35 U.S.C. 154(b) by 11 days.

(21) Appl. No.: 13/812,299

(22) PCT Filed: Jul. 29, 2011

(86) PCT No.: PCT/US2011/045860

§ 371 (c)(1),
(2), (4) Date: Jan. 25, 2013

(87) PCT Pub. No.: WO2012/016124

PCT Pub. Date: Feb. 2, 2012

(65) Prior Publication Data

US 2013/0216810 A1 Aug. 22, 2013

Related U.S. Application Data

(60) Provisional application No. 61/368,678, filed on Jul. 29, 2010.

(51) Int. Cl.
*D02G 3/04* (2006.01)
*D03D 15/12* (2006.01)

(Continued)

(52) U.S. Cl.
CPC ..... *D03D 15/12* (2013.01); *D03D 15/00* (2013.01); *D10B 2201/20* (2013.01);

(Continued)

(58) Field of Classification Search
CPC ... D03D 15/00; D03D 15/12; D10B 2201/20; D10B 2401/021; D10B 2401/022; A41B 1/00; A41B 1/02; A41B 1/06; D02G 3/04
USPC ..... 2/455, 456, 904, 69, 93, 227; 106/2, 106/15.05; 252/601, 608, 8.62; 428/920, 428/921, 219; 442/76, 79, 85, 86, 91, 92, 442/93, 94, 136, 181, 183, 199, 203, 208, 442/209, 211, 212, 213, 217, 286, 302, 414
See application file for complete search history.

(56) References Cited

U.S. PATENT DOCUMENTS 3,193,602 A 7/1965 Leonard et al.
3,748,302 A 7/1973 Jones (Continued)

FOREIGN PATENT DOCUMENTS

EP 0412195 2/1991
EP 1939339 7/2008

(Continued)

OTHER PUBLICATIONS

International Patent Application No. PCT/US2011/045860, International Search Report and Written Opinion, mailed on Mar. 28, 2012; 9 pages.

(Continued)

*Primary Examiner* — Arti Singh-Pandey
(74) *Attorney, Agent, or Firm* — Ballard Spahr LLP

(57) ABSTRACT

Optionally dyed woven fabrics and garments are disclosed that exhibit fire resistance, arc resistance, moisture management (water release rate and wicking), and abrasion resistance without the undesirable addition of topical treatments. Certain embodiments of the woven fabric are disclosed that comprise a plurality of weft yarns comprising a blend of fibers with inherently fire resistant fibers with superior moisture management properties and a plurality of warp yarns, optionally dyed, comprising cellulose derivatives. The woven fabrics are particularly useful in denim work clothes because they are comfortable to wear and exhibit fire resistance and abrasion resistance.

31 Claims, 10 Drawing Sheets

(51) Int. Cl.

| | |
|---|---|
| ***D03D 15/00*** | (2006.01) |
| ***A41B 1/00*** | (2006.01) |
| ***A41D 1/02*** | (2006.01) |
| ***A41D 1/06*** | (2006.01) |

(52) U.S. Cl.
CPC .... *D10B 2401/021* (2013.01); *D10B 2401/022* (2013.01); *A41B 1/00* (2013.01); *A41D 1/02* (2013.01); *A41D 1/06* (2013.01)

(56) References Cited

U.S. PATENT DOCUMENTS

| | | | | |
|---|---|---|---|---|
| 3,803,453 | A | 4/1974 | Hull | |
| 4,035,441 | A | 7/1977 | Endo et al. | |
| 4,107,129 | A | 8/1978 | Tanaka et al. | |
| 4,900,613 | A | 2/1990 | Green | |
| 4,920,000 | A | 4/1990 | Green | |
| 5,025,537 | A | 6/1991 | Green | |
| 5,208,105 | A | 5/1993 | Ichibori et al. | |
| 5,223,334 | A | 6/1993 | Green | |
| 5,487,936 | A | 1/1996 | Collier | |
| 5,506,042 | A | 4/1996 | Ichibori et al. | |
| 5,691,040 | A * | 11/1997 | Barbeau et al. | 428/198 |
| 6,666,235 | B2 | 12/2003 | Chi et al. | |
| 6,706,650 | B2 | 3/2004 | Gibson et al. | |
| 7,008,887 | B2 | 3/2006 | Rearick et al. | |
| 7,312,166 | B2 * | 12/2007 | Thiriot | 442/197 |
| 7,419,922 | B2 | 9/2008 | Gibson et al. | |
| 8,528,120 | B2 * | 9/2013 | Underwood et al. | 2/458 |
| 8,732,863 | B2 * | 5/2014 | Hines et al. | 2/81 |
| 2001/0009832 | A1 | 7/2001 | Shaffer et al. | |
| 2002/0098760 | A1 | 7/2002 | Butterfield et al. | |
| 2003/0226612 | A1 | 12/2003 | Zhu et al. | |
| 2005/0208855 | A1 | 9/2005 | Zhu | |
| 2006/0059634 | A1 | 3/2006 | Tutterow | |
| 2006/0211319 | A1 | 9/2006 | Masuda et al. | |
| 2006/0292953 | A1 | 12/2006 | Ashley et al. | |
| 2007/0249250 | A1 | 10/2007 | Servajean | |
| 2008/0057807 | A1 * | 3/2008 | Tutterow et al. | 442/1 |
| 2009/0053957 | A1 | 2/2009 | Zhu et al. | |
| 2010/0178829 | A1 * | 7/2010 | Kulkarni | 442/301 |
| 2010/0297905 | A1 | 11/2010 | Ulrich et al. | |
| 2012/0146784 | A1 * | 6/2012 | Hines et al. | 340/539.11 |

FOREIGN PATENT DOCUMENTS

| | | |
|---|---|---|
| JP | H05-086531 | 4/1993 |
| JP | 2006-176895 | 7/2006 |
| WO | 0000686 | 1/2000 |
| WO | 2012016124 | 2/2012 |

OTHER PUBLICATIONS

International Patent Application No. PCT/US2011/045860, International Preliminary Report on Patentability, mailed Feb. 7, 2013 (6 pages).

Decision of Rejection issued by the Japanese Patent Office on Oct. 28, 2014 for Application No. JP 2013-521996 filed on Jul. 29. (Applicant—DriFire LLC // Inventors—Hines et al.) (9 pages).

* cited by examiner

FIRE RESISTANT WOVEN FABRICS AND GARMENTS

CROSS REFERENCE TO RELATED APPLICATIONS

This application is a U.S. national phase patent application under 35 U.S.C. 371 of International Patent Application No. PCT/US 2011/045860 entitled "Fire Resistant Woven Fabrics and Garments" filed Jul. 29, 2011, which claims benefit of priority under PCT Article 8 of U.S. Provisional Application No. 61/368,678 filed Jul. 29, 2010, each of which is incorporated herein by reference in its entirety.

FIELD OF THE INVENTION

The present invention generally relates to fire resistant fabrics and garments. More particularly, the invention relates to woven fabrics, especially denim, that exhibit inherent fire resistance, arc protection, improved moisture management (water release rate, wicking, and drying time), and abrasion resistance.

BACKGROUND OF THE INVENTION

Denim is a coarse twilled fabric, usually cotton, with a pattern of diagonal parallel ribs made by passing the weft thread over one or more warp threads and then under two or more warp threads and so on, with a step or offset between rows to create the characteristic diagonal pattern. Because of this structure, twills generally drape well, and are used in jeans, overalls, work uniforms, jackets, and a variety of other garments. Because of its popularity and durability, denim has also found applications in accessories, upholstery, draperies, and linens.

Twill fabrics technically have a front and a back side, unlike plain weave, where the two sides are the same. The front side of the twill is usually called the technical face and the back is called the technical back. The technical face side of a twill weave fabric is the side with the most pronounced wale. It is usually more durable, more attractive, and most often used as the fashion side of the fabric. This side is usually the side visible during weaving. If there are warp floats on the technical face (if the warp crosses over two or more wefts), there will be filling floats (the weft will cross over two or more warps) on the technical back. If the twill wale goes up to the right on one side, it will go up to the left on the other side.

Although available in many colors, more traditional denim fabric gets its characteristic blue color from the weaving of indigo dyed warp threads and white or natural weft threads.

Traditionally, denim fabric was 100% cotton. However, there are now denim fabrics that contain cotton blends. For fashion apparel, some textile manufacturers have woven the base cotton fiber with stretch fibers, silk, and/or metallic threads. For work garments, on the other hand, textile manufacturers need to focus on providing protection in the form of fire resistance (FR) and abrasion resistance. Because of its durability and comfort, denim fabrics are often used in work clothing, including pants, overalls, jumpsuits, and jackets. Conventional FR denim products achieve their fire protection from fire resistant treatments/additives. The terms "treated" or "topically treated" refer to a manufacturing step where a special mixture of chemicals is added to non-FR fabric, such as cotton or cotton/nylon blends, to make the final fabric fire resistant. While fabrics made with inherently FR fibers, retain their FR protection throughout the life of the garment, chemically treated FR fabrics may have their flame resistant properties reduced or removed completely depending on how, and how many times these fabrics are laundered. Likewise, exposure to certain chemicals in the work environment may also diminish or eliminate the fabric FR properties. Sometimes, the treatments/additives adversely impact the comfort, including the moisture management properties (such as water release rate, horizontal and vertical wicking, and drying time). Slower drying times also lead to inconvenience and additional costs with respect to laundering. Denim fabrics that absorb large percentages of their dry weight in water or sweat lead to uncomfortable, saturated heavy fabric against the skin which can lead to rashes, skin irritation, and overall discomfort and promote environments that lead to odor formation. In addition, fiber selection to achieve fire resistance, moisture management, and abrasion resistance often negatively impacts the ability to dye the fabric, especially so that it has a traditional denim look and feel.

Accordingly, it would be desirable to provide a fabric or garment that provides permanent inherent fire resistance, arc protection, improved moisture management (water release rate, wicking, and drying time), and abrasion resistance and which may be dyed to have the desired appearance. The woven fabric and garments of the present invention are directed toward these, as well as other, important ends.

SUMMARY OF THE INVENTION

The invention relates generally to optionally dyed woven fabrics and garments that exhibit inherent fire resistance, moisture management (water release rate, wicking, and drying time), and abrasion resistance without the undesirable addition of topical treatments and/or additives. Fire resistance is an intrinsic part of inherently flame resistant fibers and is a permanent attribute of the fabric. The fire resistance cannot be washed out or worn out of the fibers, regardless of how the garment is used or laundered, under normal conditions. Certain embodiments of the woven fabric are disclosed that comprise a plurality of weft yarns comprising a blend of fibers with inherently fire resistant fibers with superior moisture management properties and a plurality of warp yarns, optionally dyed, comprising cellulose derivatives. The woven fabrics are particularly useful in denim work clothes because they are comfortable to wear, when not saturated with water, and exhibit fire resistance and abrasion resistance.

In one embodiment, the invention is directed to woven fabrics, comprising:

a. a plurality of weft yarns, comprising:
   - about 85% to about 90%, by weight, based on the total weight of the weft yarns, of hydrophobic fibers; and
   - about 10% to about 15%, by weight, based on the total weight of the weft yarns, of hydrophilic fibers; and b. a plurality of warp yarns, comprising at least about 75% by weight, based on the total weight of the warp yarns, of cellulose derivatives;
   - wherein said warp yarns have an LOI less than about 22;
   - wherein said warp yarns are optionally dyed; and
   - wherein said woven fabric optionally meets the requirement for flame resistance, as set forth in American Society for Testing and Materials Standard Performance Specification ASTM F 1506.

In another embodiment, the invention is directed to woven fabrics and to garments formed from the woven fabrics, the woven fabrics comprising:

a. a plurality of weft yarns; and b. a plurality of warp yarns;

wherein said woven fabric demonstrates horizontal wicking of less than about ten seconds according to the horizontal wicking test method, when tested in accordance with AATCC 79 Absorbency of Textiles;

wherein said woven fabric meets the requirement for flame resistance, as set forth in American Society for Testing and Materials Standard Performance Specification ASTM F 1506;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In yet another embodiment, the invention is directed to woven fabrics and to garments formed from the woven fabrics, the woven fabrics comprising:

a. a plurality of weft yarns; and b. a plurality of warp yarns;

wherein said woven fabric demonstrates vertical wicking of greater than about 5.0 cm, preferably greater than about 5.5 cm, in 5 minutes according to the vertical wicking test method, when tested in accordance with AATCC MM TS-06;

wherein said woven fabric meets the requirement for flame resistance, as set forth in American Society for Testing and Materials Standard Test ASTM F1506;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In other embodiments, the invention is directed to woven fabrics and to garments formed from the woven fabrics, the woven fabrics comprising:

a. a plurality of weft yarns; and b. a plurality of warp yarns;

wherein said woven fabric has a water release rate of greater than about 0.18% water weight per minute as said fabric dries from 20% by weight water to 1% by weight water, when tested in accordance with a modified version of the provisional AATCC Gravimetric Drying Test Method (AATCC/MM TS-05);

wherein said woven fabric meets the requirement for flame resistance, as set forth in American Society for Testing and Materials Standard Performance Specification ASTM F 1506;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In yet other embodiment, the invention is directed to woven fabrics and to garments formed from the woven fabrics, the woven fabrics comprising:

a. a plurality of weft yarns; and b. a plurality of warp yarns;

wherein said woven fabric has a water release rate from a condition of wet (saturated) (padded with AATCC blotting paper) to less than 1% by weight water of greater than about 0.25% of water weight per minute, when tested in accordance with a modified version of the provisional AATCC Gravimetric Drying Test Method (AATCC/MM TS-05)

wherein said woven fabric meets the requirement for flame resistance, as set forth in American Society for Testing and Materials Standard Test ASTM F1506;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In further embodiments, the invention is directed to woven fabrics and to garments formed from the woven fabrics, the woven fabrics comprising:

a. a plurality of weft yarns; and b. a plurality of warp yarns;

wherein said woven fabric has a weight loss of less than about 1.7% after 10,000 cycles using 600 grit sandpaper using ASTM D 4966—Abrasion Resistance of Textile Fabrics (Martindale Abrasion Tester Method—Option #3);

wherein said woven fabric meets the requirement for flame resistance, as set forth in American Society for Testing and Materials Standard Performance Specification ASTM F 1506;

wherein said woven fabric optionally provides at least about 12.0 cal/cm$^2$ of arc rated protection, when tested in accordance with the American Society of Testing and Materials Standard Test ASTM F 1959/F 1959M-06ae1;

wherein said warp yarns have an LOI less than about 22; and wherein said warp yarns are optionally dyed.

In even other embodiments, the invention is directed to woven fabrics and to garments formed from the woven fabrics, the woven fabrics comprising:

a. a plurality of weft yarns; and b. a plurality of warp yarns;

wherein said woven fabric can dry from a fully wet condition (padded) to less than 1% by weight water in less than about 185 minutes in a controlled environment of 70° F. and 55% relative humidity (+/−5% relative humidity), when tested in accordance with a modified version of the provisional AATCC Gravimetric Drying Test Method (AATCC/MM TS-05);

wherein said woven fabric meets the requirement for flame resistance, as set forth in American Society for Testing and Materials Standard Performance Specification ASTM F 1506;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In another embodiment, the invention is directed to woven fabrics and to garments formed from the woven fabrics, the woven fabrics comprising:

a. a plurality of weft yarns; and b. a plurality of warp yarns;

wherein said woven fabric has a drying time of less than about 105 minutes from 20% by weight water to 1% by weight water in a controlled environment of 70° F. and 55% relative humidity (+/−5% relative humidity), when tested in accordance with a modified version of the provisional AATCC Gravimetric Drying Test Method (AATCC/ASTM MM TS-05);

wherein said woven fabric meets the requirement for flame resistance, as set forth in American Society for Testing and Materials Standard Test ASTM F1506;

wherein said woven fabric optionally provides at least about 12.0 cal/cm$^2$ of arc rated protection, when tested in accordance with the American Society of Testing and Materials Standard Test ASTM F 1959/F 1959M-06ae1;

wherein said warp yarns have an LOI less than about 22; and wherein said warp yarns are optionally dyed.

In yet another embodiment, the invention is directed to garments, comprising:

said woven fabrics described herein;

wherein a side of said woven fabric comprising a predominant surface area of said weft yarn is positioned to face towards a wearer's skin.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Figure 1:
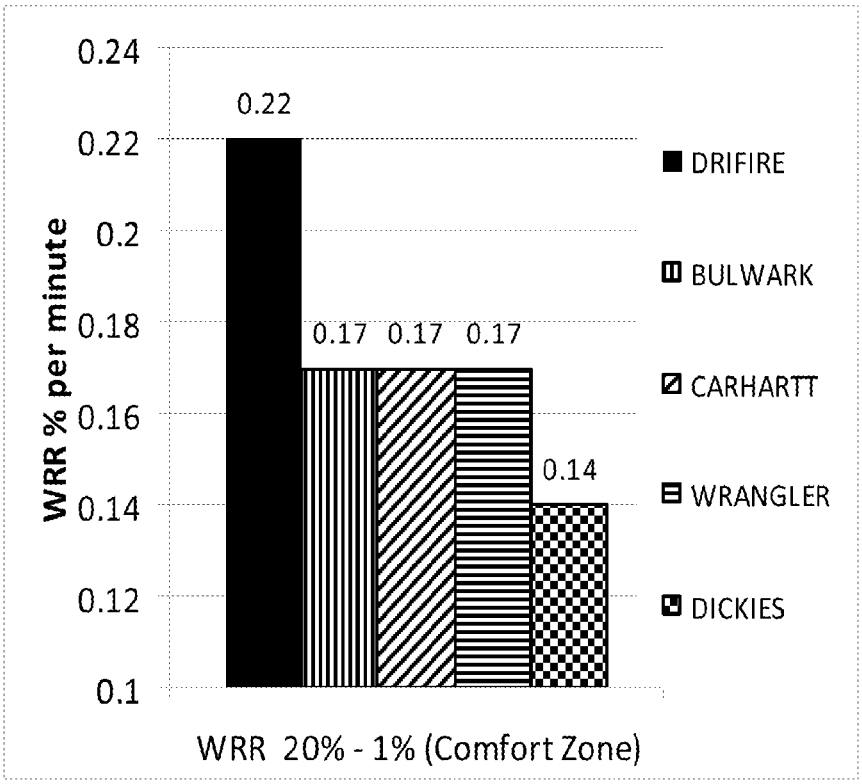
FIG. 1 is a bar graph of water release rate (WRR) 20%-1% (comfort zone) showing water release rate % per minute for a DRIFIRE FR denim sample of the invention, a Bulwark FR denim sample, a Carhartt FR denim sample, a Wrangler FR denim sample, and a Dickies FR denim sample.

As employed above and throughout the disclosure, the following terms, unless otherwise indicated, shall be understood to have the following meanings.

As used herein, the singular forms "a," "an," and "the" include the plural reference unless the context clearly indicates otherwise.

As used herein, the term "about," when referring to a measurable value such as an amount, a temporal duration, and the like, is meant to encompass variations of ±10%, preferably +5%, more preferably ±1%, and even more preferably +0.1% from the specified value, as such variations are appropriate to achieve the improved woven fabrics and garments, unless other specified. As used herein, the term "about," when referring to a range, is meant to encompass variations of ±10% within the difference of the range, preferably +5%, more preferably ±1%, and even more preferably +0.1% from the specified value, as such variations are appropriate to achieve the improved woven fabrics and garments, unless other specified.

As used herein, the term "modacrylic fiber" refers to an acrylic synthetic fiber made from a polymer comprising primarily residues of acrylonitrile. Modacrylic fibers are spun from an extensive range of copolymers of acrylonitrile. The modacrylic fiber may contain the residues of other monomers, including vinyl monomer, especially halogen-containing vinyl monomers, such as but not limited to vinyl chloride, vinylidene chloride, vinyl bromide, vinylidene bromide, and the like. The types of modacrylic fibers that can be produced within this broad category are capable of wide variation in properties, depending on their composition. Some examples of commonly available modacrylics are PROTEX™, KANEKALON™, and KANECARON™ by Kaneka Corporation, PYROTEX™, and Formosa Plastics.

As used herein, the term "aramid fiber" refers to a manufactured fiber in which the fiber-forming substance is a long-chain synthetic polyamide in which at least 85% of the amide linkages, (—CO—NH—), are attached directly to two aromatic rings.

As used herein, the term "antistatic fiber" refers to a fiber, when incorporated into a fabric or other material, eliminates or reduces static electricity. Suitable fibers include, but are not limited to, metal fibers (steel, copper or other metal), metal-plated polymeric fibers, and polymeric fibers incorporating carbon black on the surface and/or in the interior of the fiber, such as those described in U.S. Pat. Nos. 3,803,453, 4,035,441, 4,107,129, and the like. Antistatic carbon fiber is a preferred antistatic fiber. One example of such conductive fiber is NEGASTAT® produced by E.I. du Pont de Nemours and Company, a carbon fiber comprising a carbon core of conductive carbon surrounded by non-conductive polymer cover, either nylon or polyester. Another example is RESISTAT® made Shakespeare Conductive Fibers LLC, a fiber where the fine carbon particles are embossed on the surface of a nylon filament. The yarns of both such fibers are available in a denier of at least 40. By way of example, a steel wire is available under the names BEKINOX and BEKITEX from Bekaert S. A. in a diameter as small as 0.035 millimeter. Another antistatic fiber is the product X-static made by Noble Fiber Technologies, a nylon fiber coated with a metal (silver) layer. The X-static fibers may be blended with other fibers, such as modacrylics, in the process of yarn spinning.

As used herein, the term "basis weight" refers to a measure of the weight of a fabric per unit area. Typical units include ounces per square yard and grams per square meter.

As used herein, the term "garment" refers to any article of clothing or clothing accessory worn by a person, including, but not limited to shirt, pants, underwear, outer wear, footwear, headwear, swimwear, belts, gloves, headbands, and wristbands, especially those used as protective wear or gear.

As used herein, the term "linen" (when not referring to the hydrophilic fiber) refers to any article used to cover a worker or seating equipment used by workers, including, but not limited to sheets, blankets, upholstery covering, vehicle upholstery covering, and mattress covering.

As used herein, the term "intimate blend," when used in conjunction with a yarn, refers to a statistically random mixture of the staple fiber components in the yarn.

Figure 9:
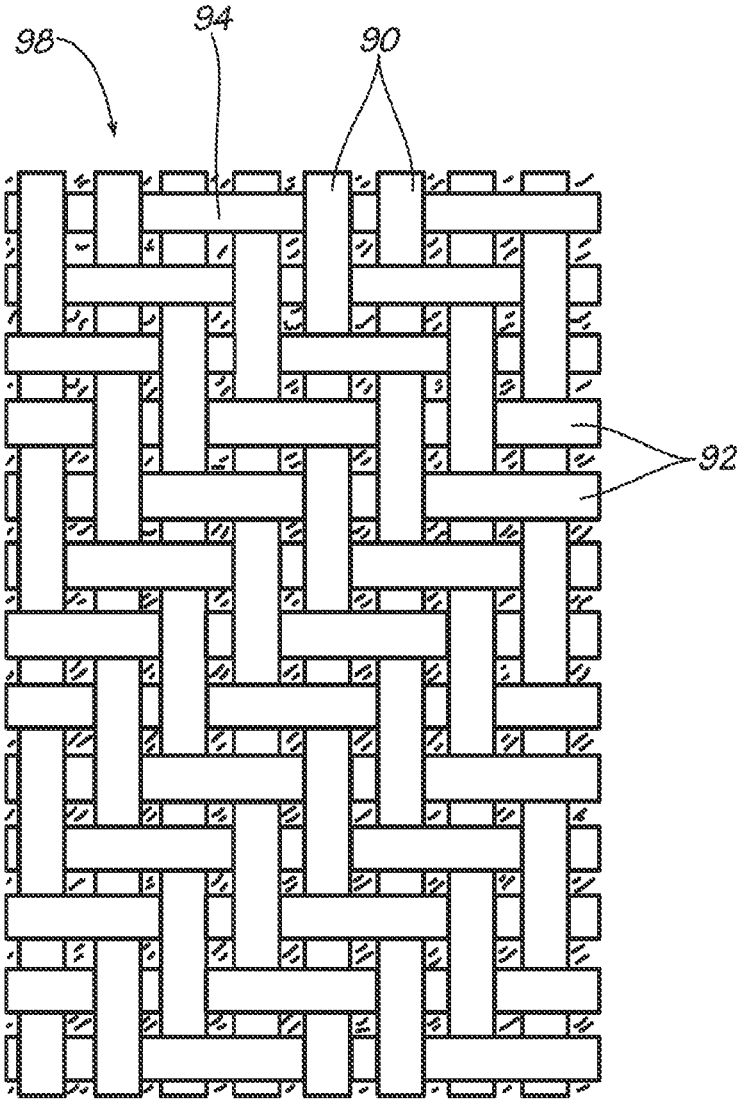
FIG. 9 is a top plan view of a technical front of a woven fabric.
Figure 10:
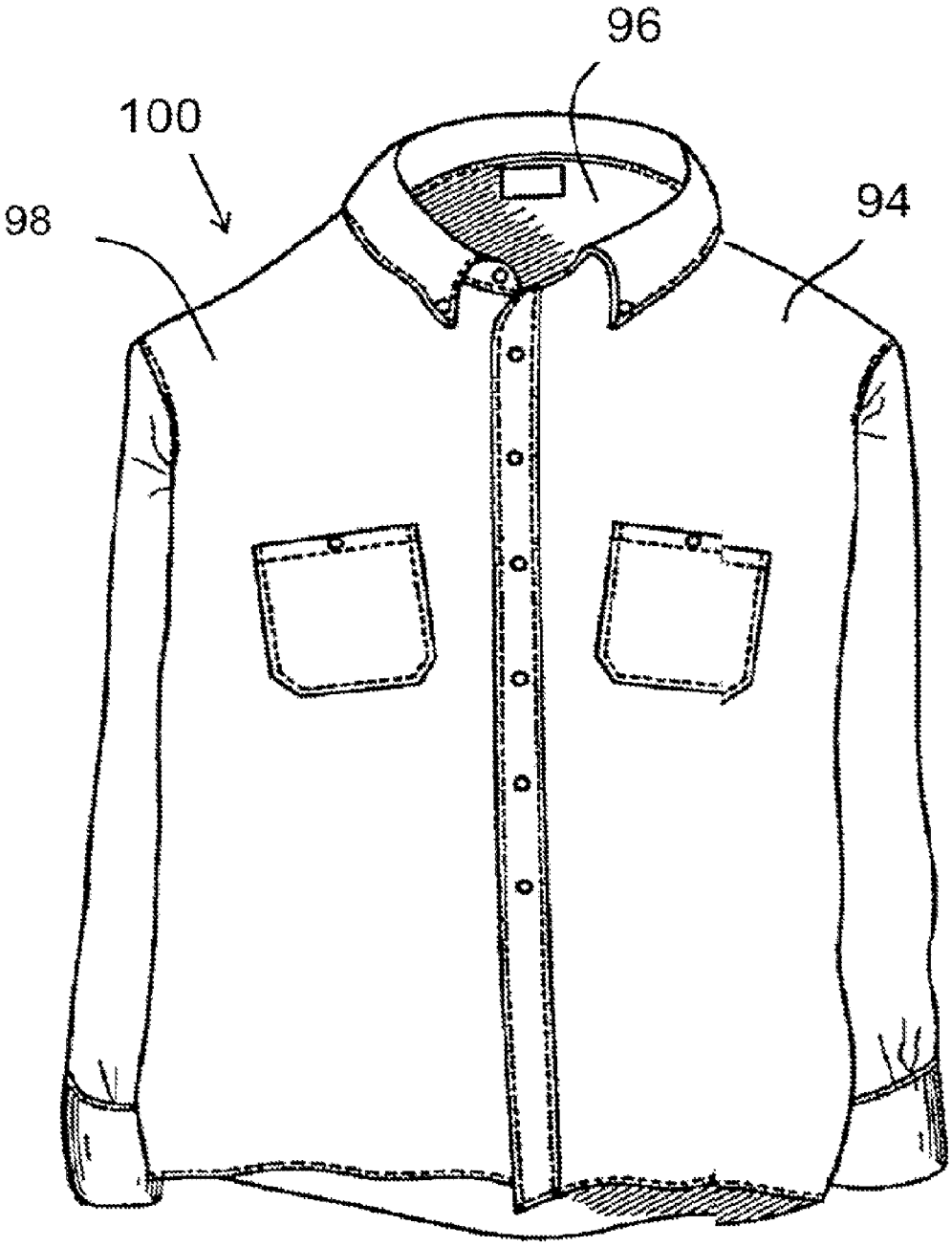
FIG. 10 is a front plan view of a shirt made of a woven fabric showing the technical front and the technical back of the woven fabric.

As used herein, the term "twill," as used in conjunction with a fabric, refers to a woven fabric with a weave pattern of diagonal parallel ribs created by passing the weft yarns over one or more warp yarns and then under two or more warp yarns and so on, with a step or offset between row, as shown in FIG. 9. In a twill weave fabric 98, each weft filling yarn 92 floats (i.e., crossing over two or more yarns from the opposite direction) across the warp yarns 90 in a progression of interlacings to the right or left, forming a distinct diagonal line (wale). Twill fabrics technically have a front and a back side, unlike plain weave, where the two sides are the same. As shown in the shirt 100 made of woven fabric 98 in FIG. 10, the front side of the twill is the "technical face" 94 and the back is called "technical back" 96. The technical face side of a twill weave fabric is the side with the most pronounced wale. It is usually more durable, more attractive, and most often used as the fashion side of the fabric. The technical face 94 is usually the side visible during weaving. The technical back 96 is the opposite side.

As used herein, the term "LOI," in reference to a yarn or fiber, refers to the minimum oxygen concentration of an $O_2/N_2$ mix required to sustain combustion of a material. The LOI is determined by the ASTM Test D 2862-77. LOIs for common fibers are:

| | |
|---|---|
| Wool 25 | Cotton 18 |
| Viscose 20 | Acetate 18 |
| Triacetate 18 | Chlorofibers 48 |
| Acrylic 18-20 | Modacrylic 22-28 |
| Polyester 20 | Polyamide 20 |
| Nylon 66 24 (melts) | PET 23 (melts) |
| PTFE 95 | m-aramid 29 |
| p-aramid | |

The invention relates generally to optionally dyed woven fabrics and garments that exhibit fire resistance, arc protection, moisture management (water release rate, wicking, and drying time), and abrasion resistance without the undesirable addition of topical treatments and/or additives. Certain embodiments of the woven fabric are disclosed that comprise a plurality of weft yarns comprising a blend of fibers with inherently fire resistant fibers with superior moisture management properties and a plurality of warp yarns, optionally dyed, comprising cellulose derivatives. The woven fabrics are particularly useful in denim work clothes because they are comfortable to wear and exhibit fire resistance and abrasion resistance.

Accordingly, in one embodiment, the invention is directed to woven fabric, comprising:

a. a plurality of weft yarns, comprising:
   about 85% to about 90%, by weight, based on the total weight of the weft yarns, of hydrophobic fibers; and
   about 10% to about 15%, by weight, based on the total weight of the weft yarns, of hydrophilic fibers; and
b. a plurality of warp yarns, comprising at least about 75% by weight, based on the total weight of the warp yarns, of cellulose derivatives;
   wherein said warp yarns have an LOI less than about 22; and
   wherein said warp yarns are optionally dyed; and
   wherein said woven fabric optionally meets the requirement for flame resistance, as set forth in American Society for Testing and Materials Standard. Performance Specification ASTM F1506.

In certain embodiments, the woven fabric demonstrates horizontal wicking of less than about ten seconds according to the horizontal wicking test method, when tested in accordance with AATCC 79 Absorbency of Textiles. In certain embodiments, the woven fabric demonstrates horizontal wicking of less than about five seconds according to the horizontal wicking test method, when tested in accordance with AATCC 79 Absorbency of Textiles. In certain embodiments, the woven fabric demonstrates horizontal wicking of less than about two seconds according to the horizontal wicking test method, when tested in accordance with AATCC 79 Absorbency of Textiles.

In certain embodiments, the woven fabric demonstrates woven fabric demonstrates vertical wicking of greater than about 5.0 cm, preferably greater than about 5.5 cm, in 5 minutes according to the vertical wicking test method, when tested in accordance with AATCC MM TS-06.

In certain embodiments, the woven fabric has a water release rate of greater than about 0.18% water weight per minute as said fabric dries from 20% by weight water to 1% by weight water (comfort zone), when tested in accordance with a modified version of the provisional AATCC Gravimetric Drying Test Method (AATCC/MM TS-05). The drying range of a fabric from 20% to 1%, by weight, of water is referred to as the "comfort zone," which is important with respect to moisture or water that is introduced into the fabric by sweat from the wearer, as opposed to rain or other saturation source, including washing.

In certain embodiments, the woven fabric has a water release rate from a condition of fully wet (padded) to less than 1% by weight water of greater than about 0.25% of water weight per minute, when tested in accordance with a modified version of the provisional AATCC Gravimetric Drying Test Method (AATCC/MM TS-05).

In certain embodiments, the woven fabric has a weight loss of less than about 1.7% after 10,000 cycles using 600 grit sandpaper using ASTM D 4966—Abrasion Resistance of Textile Fabrics (Martindale Abrasion Tester Method—Option #3). In other embodiments, the woven fabric has a weight loss of less than about 4.0%, preferably less than about 2.0%, and more preferably less than about 1.7%, after 10,000 cycles using 600 grit sandpaper using ASTM D 4966—Abrasion Resistance of Textile Fabrics (Martindale Abrasion Tester Method—Option #3).

In certain embodiments, the woven fabric can dry from a fully wet condition (padded) to less than 1% by weight water in less than about 185 minutes in a controlled environment of 70° F. (+/−2° F.) and 55% relative humidity (+/−5% relative humidity), when tested in accordance with a modified version of the provisional AATCC Gravimetric Drying Test Method (AATCC/MM TS-05).

In certain embodiments, the woven fabric has a drying time of less than about 105 minutes from containing 20% by weight water to 1% (comfort zone) by weight water in a controlled environment of 70° F. (+/−2° F.) and 55% relative humidity (+/−5% relative humidity), when tested in accordance with a modified version of the provisional AATCC Gravimetric Drying Test Method (AATCC/MM TS-05).

The weft yarn and the warp yarn may be single-ply or multi-ply.

In certain embodiments, there are preferred weft yarn counts and warp yarn counts for the woven fabrics for jeans, for lighter weight work pants, and for work shirts:

| | Weft yarn count | Warp yarn count |
|---|---|---|
| Jeans | About 4.0-12.0 (preferably about 4.0-12.0; more preferably about 5.0-7.0) | About 4.0-12.0 (preferably about 4.0-12.0; more preferably about 5.0-7.0) |
| Work Pants | About 10.0-20.0 | About 10.0-20.0 |
| Work Shirts | About 15.0-40.0 | About 15.0-40.0 |

In certain embodiments, there are basis weights for the woven fabrics for jeans, for lighter weight work pants, and for work shirts:

| | Jeans | Work Pants | Work Shirts |
|---|---|---|---|
| Basis Weight (ounces/square yard) | About 10-18 (preferably about 12-18; more preferably about 14-18) | About 7-10 | About 4-8 |

The woven fabrics of the invention are prepared by weaving various yarns. The yarns themselves may be prepared by conventional spinning techniques, including, but not limited to, open end spinning, Murata jet spinning (and vortex), ring spinning, SIRO spinning, and the like.

In various embodiments, the warp yarns are optionally dyed and the weft yarns are undyed. In certain preferred embodiments, the warp yarns are dyed with either indigo dyeing (for traditional blue colors), sulfur dyeing (for black colors and for other desired colors), or high visibility dyes. For non-traditional colors (i.e., colors other than traditional blue denim), both the warp and weft yarns may be dyed prior to weaving and/or the woven fabric may be dyed the desired color. In certain embodiments, it is desirable to have the warp yarns dyed with a high visibility dye because in a twill fabric the dyed warps yarns will be visible on the technical face of the fabric, where they are needed.

In certain embodiments of the woven fabric, said plurality of warp yarns comprise about 100% by weight, based on the total weight of the warp yarns, of said cellulose derivative.

In certain embodiments of the woven fabric, said plurality of warp yarns comprise about 100% by weight, based on the total weight of the warp yarns, of cotton.

In certain preferred embodiments, the weft yarns are formed from:

about 75%, by weight, based on the total weight of the weft yarns, of modacrylic fibers;

about 10%, by weight, based on the total weight of the weft yarns, of nylon fibers; and about 15%, by weight, based on the total weight of the weft yarns, of cotton fibers; and the said warp yarns are formed from:

about 100%, by weight, based on the total weight of the warp yarns, of cotton fibers.

In certain embodiments, the level of weft yarn making up the woven fabric is about 30% to about 70%, by weight, and, preferably, about 40% to about 60%, by weight, and, more preferably, about 40% to about 50%, and even more preferably, 42% to about 45%, by weight, based on the total weight of the woven fabric.

In certain embodiments, the surface area of the technical face contains from about 75% warp yarns and about 25% weft yarns to about 50% warp yarns and about 50% weft yarns. In certain embodiments, the surface area of the technical back contains from about 25% warp yarns and about 75% weft yarns to about 50% warp yarns and about 50% weft yarns.

In certain embodiments, the woven fabric comprises a plurality of weft yarns and a plurality of warp yarns;

wherein said woven fabric demonstrates horizontal wicking of less than about ten seconds (preferably, less than about 5 seconds, and more preferably, less than about 2 seconds) according to the horizontal wicking test method, when tested in accordance with AATCC 79 Absorbency of Textiles;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In yet another embodiment, the invention is directed to woven fabrics and to garments formed from the woven fabrics, the woven fabrics comprising:

a. a plurality of weft yarns; and b. a plurality of warp yarns;

wherein said woven fabric demonstrates vertical wicking of greater than about 5.0 cm, preferably greater than about 5.5 cm, in 5 minutes according to the vertical wicking test method, when tested in accordance with AATCC MM TS-06;

wherein said woven fabric meets the requirement for flame resistance, as set forth in American Society for Testing and Materials Standard Performance Specification ASTM F 1506;

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In certain embodiments, the woven fabric comprises a plurality of weft yarns and a plurality of warp yarns;

wherein said woven fabric has a water release rate of greater than about 0.18% water weight per minute (preferably greater than about 0.20% water weight per minute) as said fabric dries from 20% by weight water to 1% by weight water, when tested in accordance with a modified version of the provisional AATCC Gravimetric Drying Test Method (AATCC/MM TS-05);

wherein said woven fabric optionally provides at least about 12.0 cal/cm$^2$ of arc rated protection, when tested in accordance with the American Society of Testing and Materials Standard Test ASTM F 1959/F 1959M-06ae1;

wherein said warp yarns have an LOI less than about 22; and wherein said warp yarns are optionally dyed.

In certain embodiments, the woven fabric comprises a plurality of weft yarns and a plurality of warp yarns;

wherein said woven fabric has a water release rate from a condition of wet (padded) to less than 1% by weight water of greater than about 0.25% of water weight per minute (preferably greater than about 0.27% water weight per minute), when tested in accordance with a modified version of the provisional AATCC Gravimetric Drying Test Method (AATCC/MM TS-05);

wherein said woven fabric optionally provides at least about 12.0 cal/cm$^2$ of arc rated protection, when tested in accordance with the American Society of Testing and Materials Standard Test ASTM F 1959/F 1959M-06ae1;

wherein said warp yarns have an LOI less than about 22; and wherein said warp yarns are optionally dyed.

In certain embodiments, the woven fabric comprises a plurality of weft yarns and a plurality of warp yarns;

wherein said woven fabric has a weight loss of less than about 4.0% (preferably less than about 2.0% and more preferably less than about 1.7%) after 10,000 cycles using 600 grit sandpaper using ASTM D 4966—Abrasion Resistance of Textile Fabrics (Martindale Abrasion Tester Method—Option #3);

wherein said woven fabric optionally provides at least about 12.0 cal/cm$^2$ of arc rated protection, when tested in accordance with the American Society of Testing and Materials Standard Test ASTM F 1959/F 1959M-06ae1;

wherein said warp yarns have an LOI less than about 22; and wherein said warp yarns are optionally dyed.

In certain embodiments, the woven fabric comprises a plurality of weft yarns and a plurality of warp yarns;

wherein said woven fabric can dry from a fully wet condition (padded) to less than 1% by weight water in less than about 185 minutes (preferably, less than about 180 minutes, more preferably, less than about 170 minutes, yet more preferably, less than about 160 minutes, and even more preferably, less than 150 minutes) in a controlled environment of 70° F. and 55% relative humidity (+/−5% relative humidity), when tested in accordance with a modified version of the provisional AATCC Gravimetric Drying Test Method (AATCC/MM TS-05);

wherein said woven fabric optionally provides at least about 12.0 cal/cm$^2$ of arc rated protection, when tested in accordance with the American Society of Testing and Materials Standard Test ASTM F1959/F 1959M-06ae1;

wherein said warp yarns have an LOI less than about 22; and wherein said warp yarns are optionally dyed.

In certain embodiments, the woven fabric comprises a plurality of weft yarns and a plurality of warp yarns;

wherein said woven fabric has a drying time of less than about 105 minutes (preferably, less than about 100 minutes, and more preferably, less than about 90 minutes) from 20% by weight water to 1% by weight water (comfort zone) in a controlled environment of 70° F. and 55% relative humidity (+/−5% relative humidity), when tested in accordance with a modified version of the provisional AATCC Gravimetric Drying Test Method (AATCC/MM TS-05);

wherein said woven fabric optionally provides at least about 12.0 cal/cm$^2$ of arc rated protection, when tested in accordance with the American Society of Testing and Materials Standard Test ASTM F 1959/F 1959M-06ae1;

wherein said warp yarns have an LOI less than about 22; and wherein said warp yarns are optionally dyed.

Suitable hydrophobic fibers may include at least one polymer selected from the group consisting of polypropylene, polyethyleneterephthalate, polybutyleneterephthalate, poly (trimethylene terephthalate), polylactide, nylon, polyacrylonitrile, polybenzimidazole (PBI), fluoropolymer, and copolymers thereof, and combinations thereof. Preferably, the hydrophobic fiber comprises polyacrylonitrile or copolymer thereof, nylon, or a combination thereof. More preferably, the hydrophobic fiber is a combination of modacrylic and nylon.

The choice of modacrylic fibers or yarns for application in the fabric material of the invention is based on their excellent fire retardancy performance combined with their non-melt, non-drip and self-extinguishing properties. These are critically important attributes in many working environments. If sufficiently high temperatures are reached on exposure to fire or explosion, a garment made with the inventive fabric will just carbonize by forming a protective char barrier. This prevents propagation of flames, thereby protecting the wearer from severe burn injuries. Preferred modacrylic fibers for use in this invention are copolymers of acrylonitrile combined with vinylidene chloride, the copolymer having in addition an antimony oxide or antimony oxides for improved fire retardancy. Such useful modacrylic fibers include, but are not limited to, fibers disclosed U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. No. 5,208,105 and U.S. Pat. No. 5,506,042 having 8 to 40 weight percent of an antimony compound. The preferred modacrylic fiber is available commercially under the trademark of PROTEX C from Kaneka America Corporation, New York, N.Y. The preferred PROTEX C fiber is a fiber made from a copolymer of polyacrylonitrile and vinylidene chloride with 5 to 15% antimony having a linear density of 1.7 dtex/filament (1.5 denier/filament) and a cut length of 5.1 cm (2 in), although fibers having less antimony oxide, in the range of less than 5 weight percent can also be used.

Modacrylics have a high so-called LOI value as compared with other fibers. Modacrylics have an LOT value preferably between about 28 and 41.

Additionally, a very important aspect of wearing comfort is the so-called "moisture management" factor. This is often represented as the moisture vapor transport index of MVT, which reflects the efficiency in which a fabric moves perspiration away from the skin or underlying garment and causes it to evaporate into the ambient atmosphere. The MVT of the modacrylics used in the inventive fabric is approximately 2500 g/meter squared/24 hours ASTM E 96.

Modacrylic fibers used in the inventive fabric preferably have a tenacity of up to about 2.8 grams/denier, an elongation at break of between about 35% and about 40%, and a fusing temperature of between about 371° F. and about 410° F. The modacrylic fibers used in the inventive fabric also have a moisture regain (the amount of water by weight held by the fiber under controlled atmospheric conditions) of between about 0.4 and 4.0%.

Modacrylic fibers and yarns are moderately priced as compared with other materials of good thermal performance. They are readily available in the industry; they have good knitting performance, ease of fabric processing, and dyeing.

A significant attribute of modacrylics is their charring on prolonged exposure to flames, rather than simply burning and dripping. The charred portions of the fabric protect the wearer from the effects of fire.

Suitable hydrophilic fibers include at least one polymer selected from the group consisting of cellulose, cellulose derivative (such as cotton, viscose, linen, rayon, fire-resistant rayon, lyocell, or a combination thereof), wool, and copolymers thereof, and combinations thereof. Preferably, the hydrophilic fiber comprises cotton or fire-resistant rayon, or a combination thereof. In certain embodiments, the hydrophilic fiber is a cellulose derivative, including but not limited to, cotton, viscose, linen, rayon, or a combination thereof. In certain embodiments, the hydrophilic fiber is cotton, especially cotton that has not been treated with a fugitive fire resistant treatment.

In certain embodiments, either the warp yarn or weft yarn may optionally contain at least one structural fiber selected from the group consisting of aramid polymer, melamine polymer, and combinations thereof. In typical embodiments, the structural fibers are present at about 5-30%, by weight, based on the total weight of the fabric. In certain other embodiments, the structural component is present at about 20-30%, by weight, based on the total weight of the fabric. In other embodiments, the structural component is aramid polymer, such as m-aramid polymer or p-aramid polymer.

In certain embodiments, either the warp yarn or weft yarn may optionally contain at least one antistatic fiber. In typical embodiments, the antistatic fibers(s) are present at about 0.1-2.5% by weight, based on the total weight of the fabric.

The woven fabric may contain other components and treatments. For example, the fabric may contain anti-microbial and/or anti-odor components, such as, for example, triclosan, silver, and the like. The woven fabric may also be treated with a stain release agent or water repellant on the outside surface of the fabric to reduce overall absorbency of the warp yarn, thereby further improving moisture management. Suitable stain release agents and water repellants include conventional fluoropolymers and silicone polymers (such as EPIC by Nextec and DWR from Xeromax).

In another aspect, the fibers making up the weft yarns are substantially intimately blended. In another aspect, the fibers making up the warp yarn are substantially intimately blended.

In certain embodiments, the woven fabric is a twill fabric having a technical face and a technical back;

wherein said technical face comprises a predominant amount of said warp yarns; and wherein said technical back comprises a predominant amount of said weft yarns.

In other aspects, the invention is directed to articles of manufacturer comprising the woven fabrics described herein. In preferred embodiments, the garments, comprise the woven fabric described herein; wherein a side of the woven fabric comprising said weft yarn is positioned to face towards a wearer's skin to provide moisture management (wicking of sweat, for example). The garments may be any conventional item that is worn. Since the fabrics exhibit fire resistance, moisture management, and abrasion resistance, they are particularly useful in work clothing, especially denim work clothing, such as a pant, coat/jacket, or shirt.

In certain embodiments, the garment, comprises:

said woven fabric described herein;

wherein a side of said woven fabric comprising a predominant surface area of said weft yarn is positioned to face towards a wearer's skin.

In certain embodiments, the garment, comprises:

wherein a side of said woven fabric positioned to face away from a wearer's skin is treated with a stain release agent or water repellant.

The present invention is further defined in the following Examples, in which all parts and percentages are by weight, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

EXAMPLES

Example 1

The tumble dry times were compared for denim pants made from the woven fabric of the invention and commercial available fire resistant (FR) 100% cotton denim pants from Bulwark.

Tumble Dry Time Test was conducted as described below:

A load of FR Denim Pants (6 pants per load of Drifire or Bulwark) was subjected to a wash cycle at Warm/Cold setting in top loading American Washer (Sears Kenmore 70 Series Heavy Duty Plus) using 44 g of AATCC detergent. Dry weight was recorded for both loads prior to washing. Wet weight was recorded after washing. Then the load was tumbled dry at Medium Heat-165° F. Dryer used was Continental Industrial Dryer CG30-40 dryer with a capacity of 35 pounds dry weight. After running the dryer for 25 minutes, dryer was stopped and weight of the load was recorded every minute. Load was considered dry when the weight of load reached the initial dry weight. Drying time was reported. The results are shown in Table 1 below.

TABLE 1

| Item/Fabric | Fabric Content | Arc Rating cal/cm$^2$ | Weight 0z/Sq Yd | Wet Pick Up (after washing) % | Drying Time (Tumble Dry Time Test) minutes |
|---|---|---|---|---|---|
| Sample 1 (Drifire T-3907 FR Denim) | weft: 75% modacrylic 10% nylon 15% cotton warp: 100% cotton overall fabric: 57% cotton 38% modacrylic 5% nylon | 16.2 (Ebt) | 15.248 | 51.7% | 34.0 |
| Comparative Sample 2 Bulwark (Excel FR fabric)-VF Imagewear Inc. | 100% cotton (FR Denim) | 20.7 (ATPV) | 15.344 | 50.6% | 41.0 |

In summary, there was a 17.07% improvement in tumble dry time of Sample 1 of the invention over conventional Comparative Sample 2.

Example 2

The performance of four commercially-available FR denims (from Bulwark, Carhartt, Wrangler, and Dickies) were compared to the performance of the woven fabric of the invention (Drifire FR Denim T-3907) in terms water release rate (WRR), drying time, horizontal wicking, vertical wicking (moisture management) and abrasion resistance. The results are shown in Table 2 and Table 3 and in FIGS. 1 to 8.

TABLE 2

| Item/Fabric | Fiber Content | Weight 0z/Sq. Yd. | Wet Pick-Up % | Horizontal Wicking seconds | Vertical Wicking Length (in 5 minutes) cm | % Weight Loss after Abrasion (10,000 Cycles) % |
|---|---|---|---|---|---|---|
| Drifire Style# T-3907 (1 Wash-Home Laundering) FR Denim[1] | weft: 75% modacrylic 10% nylon 15% cotton warp: 100% cotton overall fabric: 57% cotton 38% modacrylic 5% nylon | 15.25 | 43.65% | 0-1 | 5.7 | 1.66% |
| Bulwark FR Denim (as received) | 100% cotton | 15.34 | 47.62% | 22-26 | 4.8 | 5.74% |
| Carhartt FR Denim (as received) | 100% cotton | 11.70 | 45.10% | 18-21 | 4.3 | 4.49% |
| Wrangler FR Denim (as received) | 100% cotton | 15.50 | 51.02% | 12-13 | 5.2 | 1.73% |
| Dickies FR Denim (as received)) | 100% cotton | 14.00 | 48.40% | >60 | 0.3 | 4.08% |

| Item/Fabric | Fiber Content | Weight 0z/Sq. Yd. | Total Dry Time (Total −1% Moisture) minutes | Dry Time in Comfort Zone (20-1% Moisture) minutes | WRR (Total −1% Moisture) % per minute | WRR in Comfort Zone (20-1% Moisture) % per minute |
|---|---|---|---|---|---|---|
| Drifire Style# T-3907 (1 Wash-Home Laundering) FR Denim | weft: 75% modacrylic 10% nylon 15% cotton warp: 100% cotton overall fabric: 57% cotton 38% modacrylic 5% nylon | 15.25 | 149.7 | 86.1 | 0.29 | 0.22 |
| Bulwark FR Denim (as received) | 100% cotton | 15.34 | 191.9 | 110.4 | 0.24 | 0.17 |
| Carhartt FR Denim (as received) | 100% cotton | 11.70 | 189.9 | 117.1 | 0.23 | 0.17 |
| Wrangler FR Denim (as received) | 100% cotton | 15.50 | 202.8 | 114.9 | 0.25 | 0.17 |
| Dickies FR Denim (as received) | 100% cotton | 14.00 | 210.6 | 138.6 | 0.23 | 0.14 |

[1]To ensure comparable test conditions, the Drifire sample was washed since it was an off the roll fabric sample and the comparative samples were garments that were previously washed.

TABLE 3

| | % Improvement of Drifire FR Denim of Invention over | | | |
|---|---|---|---|---|
| | Bulwark | Carhartt | Wrangler | Dickies |
| Water Release Rate (20% to 1%) | 29.41% | 29.41% | 29.41% | 57.14% |
| Drying Time (20% to 1%) | 22.01% | 26.51% | 25.07% | 37.91% |
| Water Release Rate (Total to 1%) | 20.83% | 26.09% | 16.00% | 26.09% |
| Drying Time (Total to 1%) | 21.99% | 21.17% | 26.17% | 28.93% |
| Vertical Wicking | 18.75% | 32.56% | 9.62% | 1800.00% |
| Horizontal Wicking | 0-1 sec v. 22-26 sec | 0-1 sec v. 18-21 sec | 0-1 sec v. 12-13 sec | 0-1 sec v. >60 sec |

Vertical Wicking: Vertical wicking length is the distance of water travel in the vertical direction in 5 minutes.

Martindale Abrasion Test:

1. Test Method ASTM D4966 (Abrasion Resistance of Textile Fabrics) (Martindale Abrasion Tester Method Option 3) Modified;
2. Abradant used was 600 grit sandpaper (Modification to this test was the use of this grade of sandpaper to accelerate abrasion and to simulate rough surfaces);
3. All were subject to 10,000 abrasion cycles.

Comparative FR denims were tested, as received, Drifire finished fabric was washed once before testing to bring the test sample on par to the pre-washed FR Denims.

Figure 2:
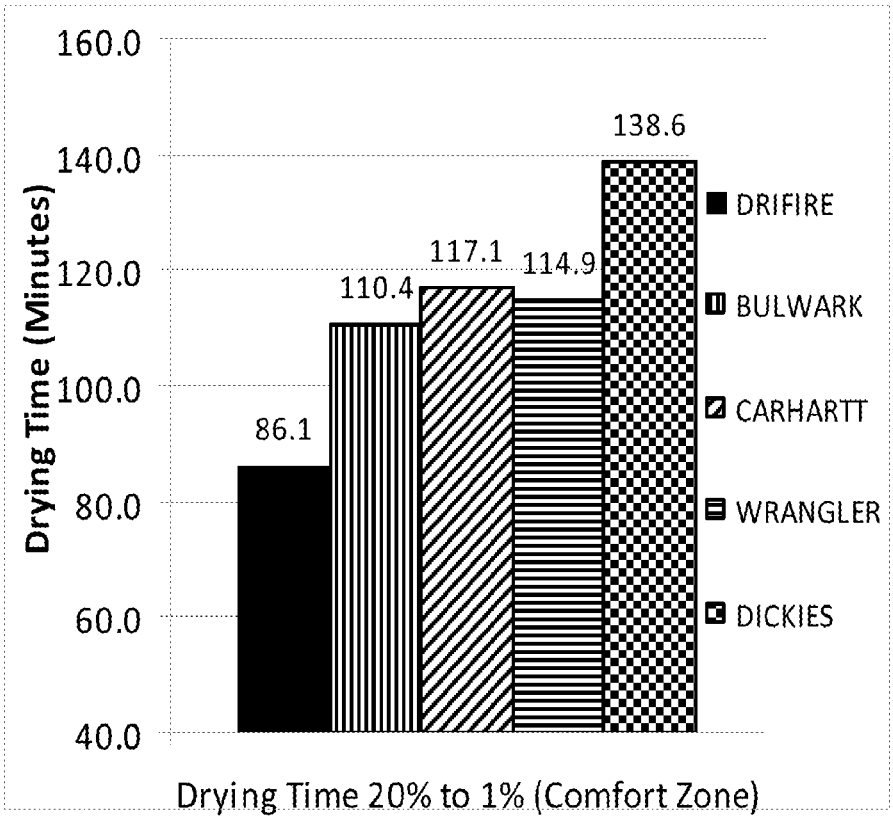
FIG. 2 is a bar graph of drying time 20%-1% (comfort zone) showing drying time in minutes for a DRIFIRE FR denim sample of the invention, a Bulwark FR denim sample, a Carhartt FR denim sample, a Wrangler FR denim sample, and a Dickies FR denim sample.
Figure 3:
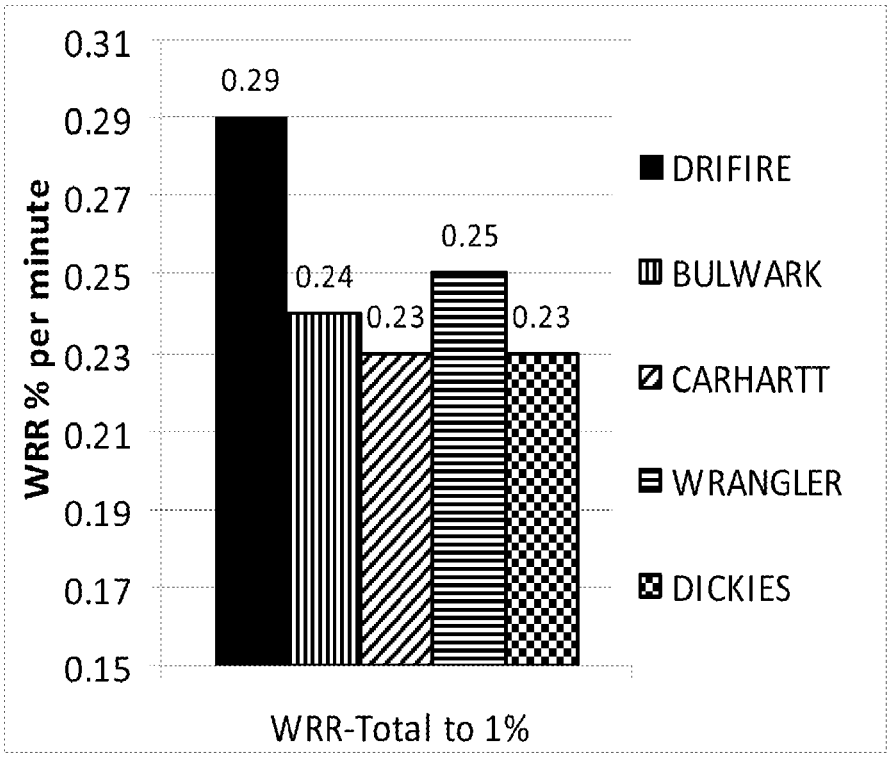
FIG. 3 is a bar graph of water release rate from padded fully wet (total) to 1% showing water release rate % per minute for a DRIFIRE FR denim sample of the invention, a Bulwark FR denim sample, a Carhartt FR denim sample, a Wrangler FR denim sample, and a Dickies FR denim sample.
Figure 4:
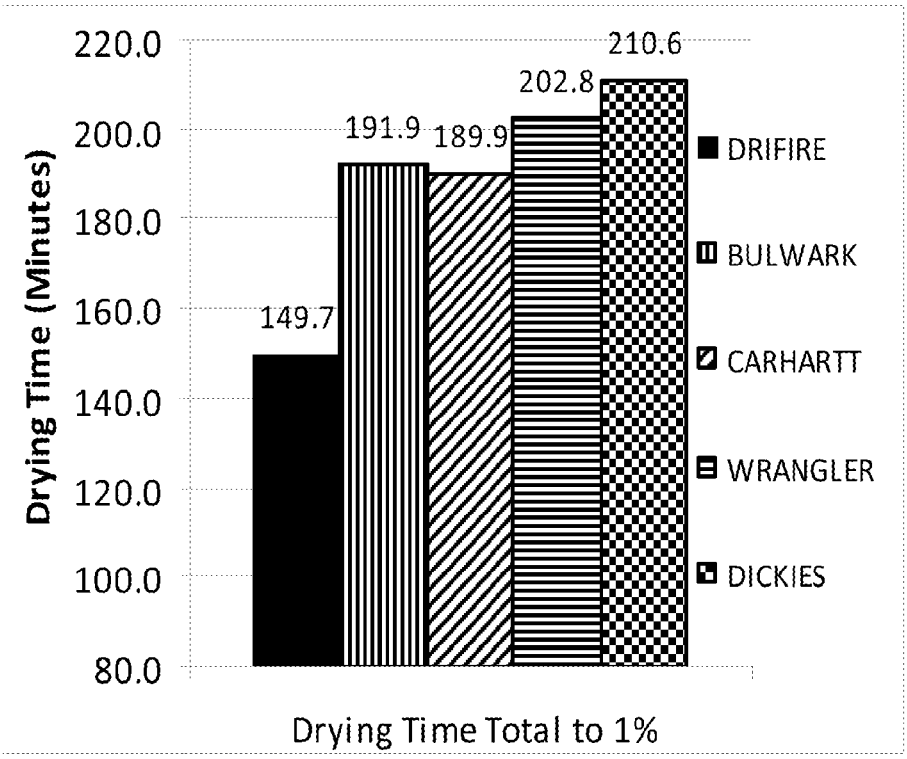
FIG. 4 is a bar graph of water release rate from padded fully wet (total) to 1% showing drying time in minutes for a DRIFIRE FR denim sample of the invention, a Bulwark FR denim sample, a Carhartt FR denim sample, a Wrangler FR denim sample, and a Dickies FR denim sample.
Figure 5:
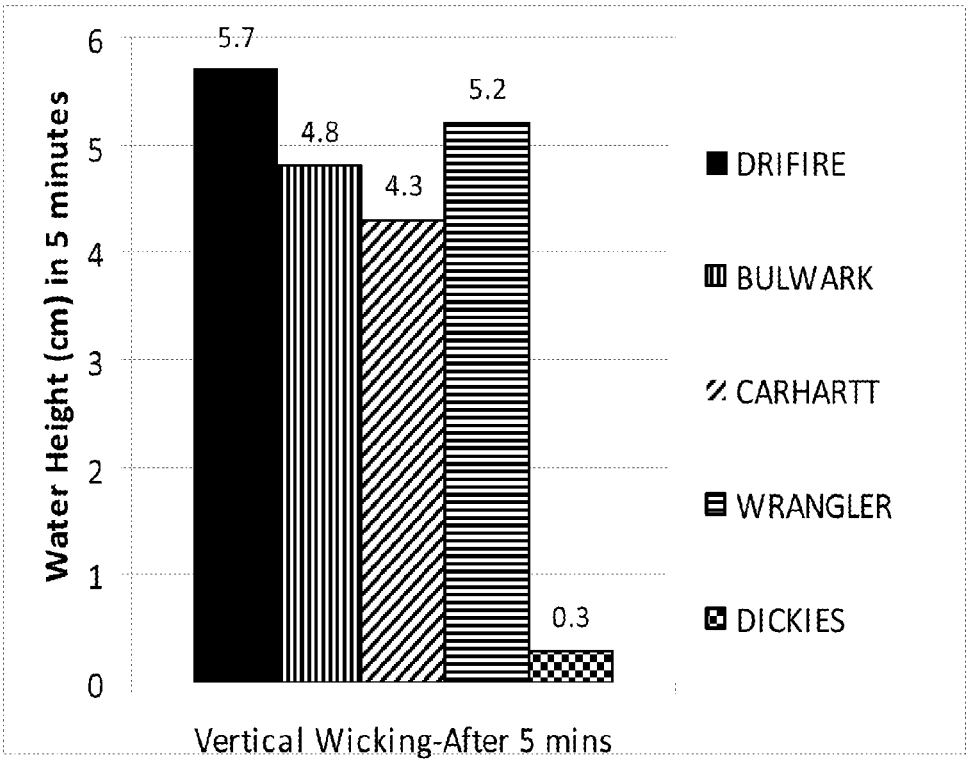
FIG. 5 is a bar graph of vertical wicking after five minutes showing water height in centimeters for a DRIFIRE FR denim sample of the invention, a Bulwark FR denim sample, a Carhartt FR denim sample, a Wrangler FR denim sample, and a Dickies FR denim sample.
Figure 6:
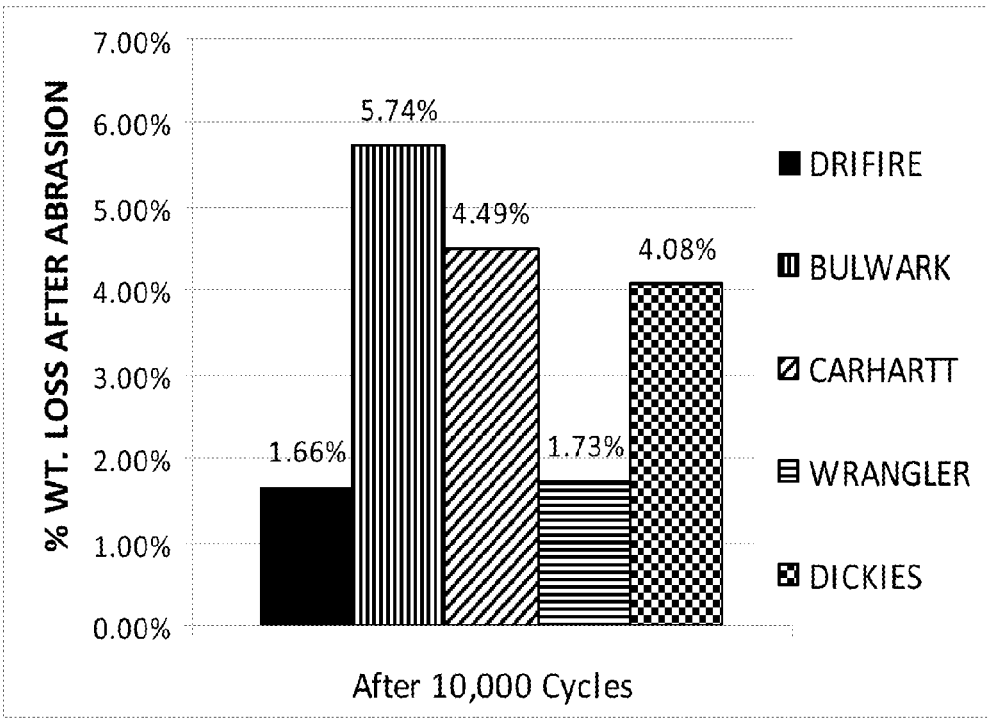
FIG. 6 is a bar graph of abrasion resistance showing for % weight loss after 10,000 cycles of abrasion testing for a DRIFIRE FR denim sample of the invention, a Bulwark FR denim sample, a Carhartt FR denim sample, a Wrangler FR denim sample, and a Dickies FR denim sample.
Figure 7:
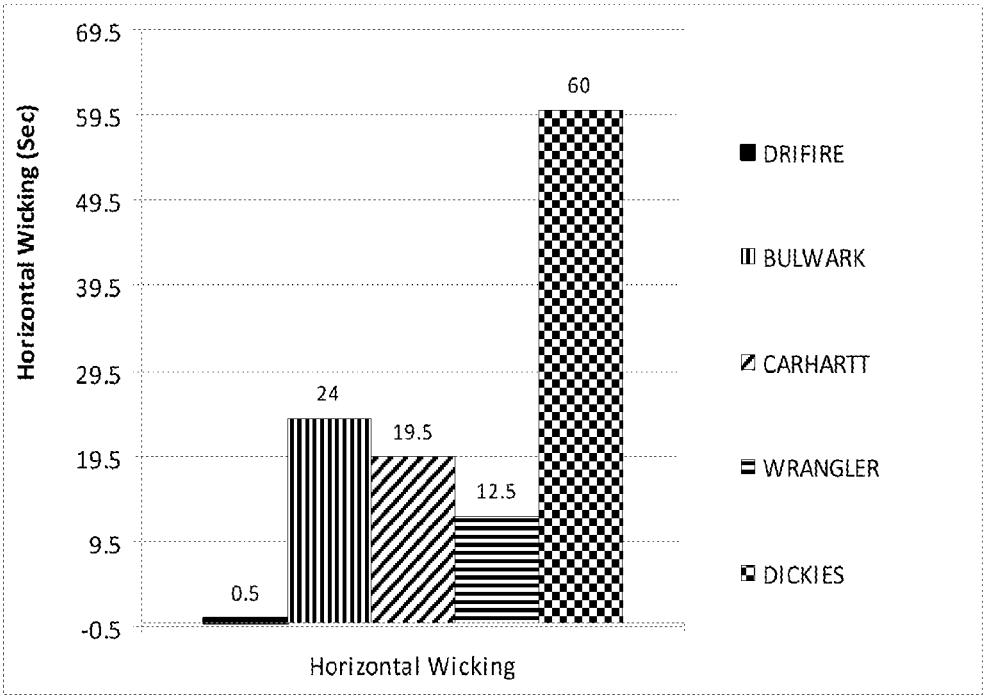
FIG. 7 is a bar graph of horizontal wicking in seconds for a DRIFIRE FR denim sample of the invention, a Bulwark FR denim sample, a Carhartt FR denim sample, a Wrangler FR denim sample, and a Dickies FR denim sample.
Figure 8C:
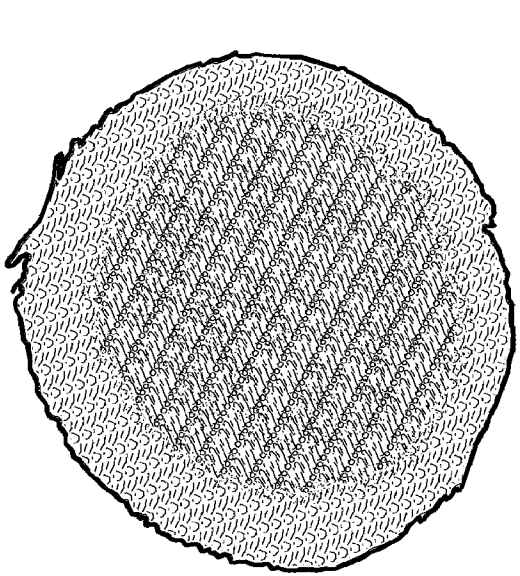
FIG. 8 is a series of photographs of a DRIFIRE FR denim sample of the invention (8A), a Bulwark FR denim sample (8B), a Carhartt FR denim sample (8C), a Wrangler FR denim sample (8D), and a Dickies FR denim sample (8E) after 10,000 cycles of abrasion testing.
Figure 8B:
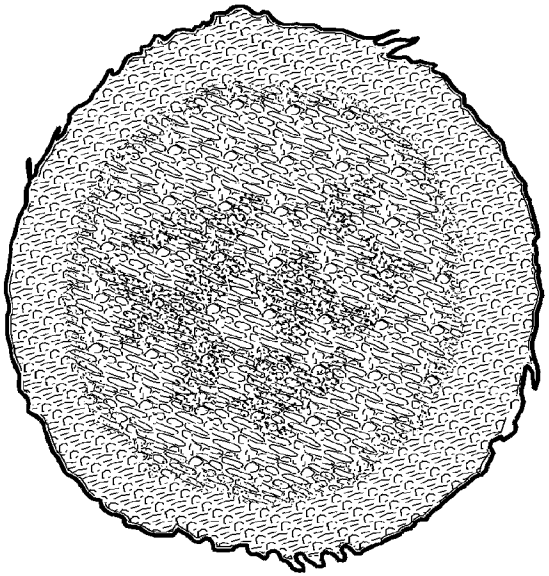
Figure 8A:
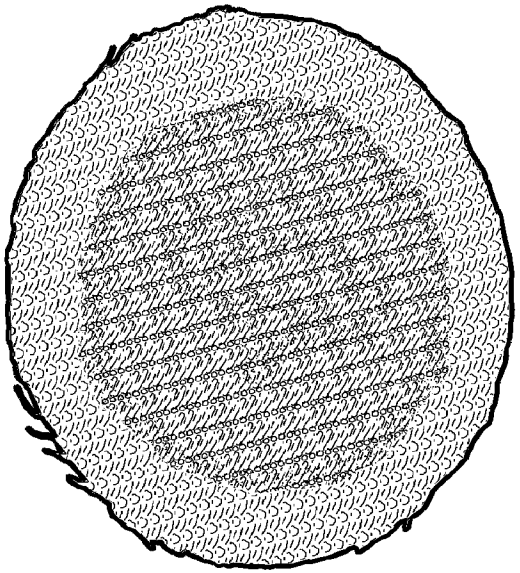
Figure 8E:
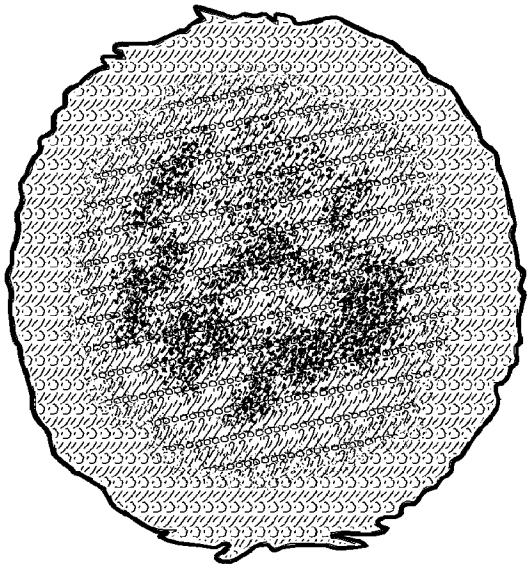
Figure 8D:
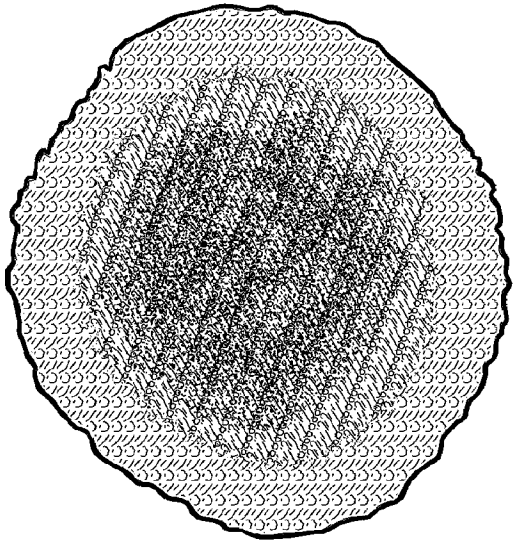

Summary of Results:

1. Horizontal wicking (AATCC 79 Absorbency of Textiles): Drifire FR denim is more absorbent and demonstrates better wicking than competition FR denims, as shown in FIG. 7.
2. Vertical wicking (AATCC MM TS-06 Vertical Wicking-modified-Hanes protocol): Drifire FR denim demonstrates better vertical wicking than competition FR denims, as shown in FIG. 5.
3. Water release rate (AATCC MM TS-05 Gravimetric Drying Test modified): DRIFIRE FR denim performs better in "Water Release Rate" (16%-57%) compared to competition FR denims, as shown in FIGS. 1 and 3 (16% to 26% total to 1% and in the comfort zone (20% to 1%) of 29% to 57%).
4. Drying time (MM TS-05 Gravimetric Drying Test modified): Drifire FR denim dries 21-37% faster than competition FR denims, as shown in FIGS. 2 and 4.
5. Abrasion Resistance (ASTM D 4966-modified): Drifire FR Denim has better abrasion resistance than competition FR denims. Abrasion resistance of Wrangler FR Denim is close or slightly lower to that of Drifire FR denim, as shown in FIGS. 6 and 8 (8A through 8E).

Conclusion: The denim of the invention provides better fabric performance in terms of water release rate (WRR), drying time, horizontal wicking, vertical wicking (moisture management) and demonstrates better abrasion resistance than the FR Denims of Bulwark, Carhartt, Wrangler, and Dickies.

Example 3

Flame Resistance of Textiles (Vertical) (ASTM D6413): This test method determines the response of textiles to a standard ignition source, deriving measurement values for after-flame time, afterglow time, and char length. The vertical flame resistance, as determined by this test method, only relates to a specified flame exposure and application time. This test method maintains the specimen in a static, draft-free, vertical position and does not involve movement except that resulting from the exposure. Test Method D6413 has been adopted from Federal Test Standard No. 191A method 5903.1, which has been used for many years in acceptance testing.

Samples cut from fabric to be tested are mounted in a frame that hangs vertically from inside the flame chamber. A controlled flame is exposed to the sample for a specified period of time. After-flame time, the length of time the material continues to burn after removal of the burner, and after-glow time, the length of time the material glows after the flame extinguishes, are both recorded. Finally, the specimen is torn by use of weights and the char length, the distance from the edge of the fabric that was exposed to the flame to the end of the area affected by the flame, is measured.

Five fabric specimens (DRIFIRE denim: weft: 75% modacrylic/10% nylon/15% cotton; warp: 100% cotton; overall fabric: 57% cotton/38% modacrylic/5% nylon) were tested, as received, in accordance with ASTM D6413 to measure flame resistance. The test results are shown in Table 4:

TABLE 4

| | After-Flame (seconds) | After-Glow (seconds) | Melting Drip (seconds) | Char Length (inches) |
|---|---|---|---|---|
| Warp Direction | | | | |
| Sample 1 | 0.0 | 91.6 | 0.0 | 2.6 |
| Sample 2 | 0.0 | 70.8 | 0.0 | 2.5 |
| Sample 3 | 0.0 | 109.1 | 0.0 | 2.9 |
| Sample 4 | 0.0 | 94.7 | 0.0 | 3.3 |
| Sample 5 | 0.0 | 93.3 | 0.0 | 3.2 |
| Average | 0.0 | 91.9 | 0.0 | 2.9 |
| Fill Direction | | | | |
| Sample 1 | 0.0 | 65.2 | 0.0 | 2.1 |
| Sample 2 | 0.0 | 64.7 | 0.0 | 2.1 |
| Sample 3 | 0.0 | 65.6 | 0.0 | 2.1 |
| Sample 4 | 0.0 | 60.9 | 0.0 | 2.2 |
| Sample 5 | 0.0 | 73.0 | 0.0 | 1.8 |
| Average | 0.0 | 65.9 | 0.0 | 2.1 |

After 25 launderings (AATCC 135(3.1V.Aiii) (results shown in Table 5):

TABLE 5

| | After-Flame (seconds) | After-Glow (seconds) | Melting Drip (seconds) | Char Length (inches) |
|---|---|---|---|---|
| Warp Direction | | | | |
| Sample 1 | 0.0 | 54.5 | 0.0 | 3.2 |
| Sample 2 | 0.0 | 45.1 | 0.0 | 2.3 |
| Sample 3 | 0.0 | 43.0 | 0.0 | 3.0 |
| Sample 4 | 0.0 | 45.8 | 0.0 | 3.0 |
| Sample 5 | 0.0 | 51.0 | 0.0 | 2.8 |
| Average | 0.0 | 47.9 | 0.0 | 2.9 |
| Fill Direction | | | | |
| Sample 1 | 0.0 | 38.3 | 0.0 | 2.2 |
| Sample 2 | 0.0 | 36.5 | 0.0 | 2.8 |
| Sample 3 | 0.0 | 35.8 | 0.0 | 2.7 |
| Sample 4 | 0.0 | 34.1 | 0.0 | 2.2 |
| Sample 5 | 0.0 | 40.4 | 0.0 | 2.6 |
| Average | 0.0 | 37.0 | 0.0 | 2.5 |

TABLE 5-continued

| | After-Flame (seconds) | After-Glow (seconds) | Melting Drip (seconds) | Char Length (inches) |
|---|---|---|---|---|
| ASTM F1506 Requirements | | | | |
| | 2.0 seconds (maximum) | | None | 6 inches (maximum) |

The woven fabric of the invention passed the flammability requirements of ASTM F 1506 Section 7.6, as received and after home launderings.

Example 4

Blue denim FR fabric (DRIFIRE denim: weft: 75% modacrylic/10% nylon/15% cotton; warp: 100% cotton; overall fabric: 57% cotton/38% modacrylic/5% nylon; 14.5 oz/sq yd indigo dyed denim fabric) were tested for dimensional change, colorfastness, and tensile strength after industrial laundering The submitted fabric were subjected to 100 industrial wash (140° C. water, alkali, acid sour, without bleach) and tumble dry cycles. After the $1^{st}$, $25^{th}$, $50^{th}$, $75^{th}$ and $100^{th}$ wash cycles the fabric were evaluated according to ASTM D 5034 Tensile Strength (Grab Method) for breaking strength and AATCC Methods for Instrumental Color Measurement. The denim fabric were assessed for dimensional change (shrinkage or growth) according to AATCC TM 96 at the same intervals. The results are shown in Table 6:

TABLE 6

| Test Conducted | | Results after wash interval | | | | | |
|---|---|---|---|---|---|---|---|
| | | Original | 1x | 25x | 50x | 75x | 100x |
| Fabric (with Benchmarks) | Length | 18" | 1.4 | 4.7 | 4.7 | 4.8 | 5.8 |
| | Width | 18" | 0.5 | 3.1 | 2.6 | 2.7 | 3.0 |
| Tensile Strength (lb/f) | Length | 179.7 | 179.0 | 168.0 | 165.0 | 163.2 | 156.5 |
| | Width | 171.9 | 172.0 | 156.0 | 151.5 | 151.9 | 156.4 |

| Color Measurement | | | | |
|---|---|---|---|---|
| Wash Cycle | "L" Value | "a" Value | "b" Value | Delta E (AATCC) |
| Original | 23.62 | −.76 | −3.21 | — |
| 1xCW | −3.39 | .25 | −1.48 | 3.71 (3.0) |
| 25xCW | −.04 | .62 | −5.73 | 5.76 (2.5) |
| 50xCW | 5.17 | −.05 | −7.13 | 8.80 (1.5) |
| 75xCW | 7.71 | −.15 | −8.10 | 11.18 (1.5) |
| 100xCW | 10.31 | −.09 | −8.85 | 13.59 (1.0) |

The denim fabric was washed in the industrial formula as described in a 35 lbs. Milner washer. The denim FR fabric was washed in a 20 lbs., load that was maintained by adding ballast of a similar denim fabric when fabric was pulled for testing after the first, $25^{th}$, $50^{th}$, $75^{th}$, and 100 cycles.

Dimensional change is the increase (growth) or decrease (shrinkage) in the length or width of a fabric and is reported as a percentage. Dimensional change can be affected by the fiber content, fabric construction, and the care method. In evaluating the unstructured fabrics, three benchmarks in the length and width directions are measured after laundering at the specified intervals and an average of the percentage of increase or decrease in the measurement is reported.

Tensile strength is the amount of force required to break a group of yarns and is reported as pounds per force or lb/f. Five specimens from the length and width directions of a fabric were used for each test. An average is recorded for the final result.

A numerical representation of the fabric color after the specified washing intervals was measured with a Hunter ColorFlex spectrocolorimeter with 45/0 geometry. The illuminant/observer used was D65/10. The CIE L*a*b* is used for determining the color value. L* has a maximum of 100 (white) and minimum of 0 (black). Positive a* represents red and negative a* represents green color. Positive b* represents yellow and negative b* represents blue. The a* and b* values have no numerical limits. Delta E represents the total color difference but does not indicated which parameter is out of tolerance. AATCC Gray Scale ratings that are equivalent to the Delta E measurements are in parentheses ( ). The Gray Scale numerical rating ranges from 5 to 1 whereby 5=no color change, 4=slight color change, 3=noticeable color change, 2=severe color change, and 1=very severe color change.

Dimensional Stability

Based on test results, when the denim FR fabric was subjected to industrial washing and evaluated after the first wash cycle shrinkage averaged 1.4% in the length and 0.5% in the width. After 25 care processes shrinkage averaged 4.7% in the length and 3.1% in the width.

The denim showed stability in the length when measured after the $50^{th}$ and $75^{th}$ cycle with shrinkage averaging 4.7% and 4.8%, respectively. However, the width direction, after 50 and 75 wash cycles the denim showed slightly less shrinkage than it did after 25 washes, averaging 2.6% and 2.7%, respectively.

After 100 industrial washes, the denim fabric showed slightly increased shrinkage in both directions, averaging 5.8% in the length and 3.0% in the width.

Tensile Strength

Initially, the denim showed a tensile strength average of 179.7 lb/f in the length and 172.0 lb/f in the width. After the first wash and dry cycle, tensile strength was nearly the same, averaging 179.0 lb/f in the length and 170.0 lb/f in the width.

Tensile strength continued to decrease in the length with repeated care processes but fluctuated up and down in the width. After 100 care processes tensile strength averaged 156.5 lb/f in the length, only a 13% drop in overall strength from the original fabric. at the same evaluation interval the width direction of this fabric showed an average tensile strength of 156.4 lb/f, indicating a 9.0% drop in strength.

Color Measurement

Instrumental measurement readings indicate the denim FR fabric shows a noticeable color change after the first care process. As expected the denim continued to lose color with repeated washing and instrumental assessment showed a very severe color change after 100 care processes.

When ranges are used herein for physical properties, such as molecular weight, or chemical properties, such as chemical formulae, all combinations, and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A woven fabric, comprising:

a. a plurality of weft yarns, comprising:

about 85% to about 90%, by weight, based on the total weight of the weft yarns, of hydrophobic fibers; and about 10% to about 15%, by weight, based on the total weight of the weft yarns, of hydrophilic fibers; and b. a plurality of warp yarns, comprising at least about 75% by weight, based on the total weight of the warp yarns, of cellulose derivatives;

wherein said warp yarns have an LOI less than about 22;

wherein said warp yarns are optionally dyed; and wherein said woven fabric optionally meets the requirement for flame resistance, as set forth in American Society for Testing and Materials Standard Performance Specification ASTM F1506.

2. A woven fabric of claim 1, said woven fabric provides a minimum of 12.0 cal/cm$^2$ of arc rated protection to the wearer, when tested in accordance with American Society of Testing and Materials Standard Test ASTM F1959/F 1959M-06ae1.

3. A woven fabric of claim 1, wherein said woven fabric demonstrates horizontal wicking of less than about ten seconds according to the horizontal wicking test method, when tested in accordance with AATCC 79 Absorbency of Textiles.

4. A woven fabric of claim 1, wherein said woven fabric demonstrates vertical wicking of greater than about 5.0 cm in 5 minutes according to the vertical wicking test method, when tested in accordance with AATCC MM TS-06.

5. A woven fabric of claim 1, wherein said woven fabric has a water release rate of greater than about 0.18% water weight per minute as said fabric dries from 20% by weight water to 1% by weight water, when tested in accordance with a modified version of the provisional AATCC Gravimetric Drying Test Method (AATCC/MM TS-05).

6. A woven fabric of claim 1, wherein said woven fabric has a water release rate from a condition of wet (padded) to less than 1% by weight water of greater than about 0.25% of water weight per minute, when tested in accordance with a modified version of the provisional AATCC Gravimetric Drying Test Method (AATCC/MM TS-05).

7. A woven fabric of claim 1, wherein said woven fabric has a weight loss of less than about 2% after 10,000 cycles using 600 grit sandpaper using ASTM D 4966—Abrasion Resistance of Textile Fabrics (Martindale Abrasion Tester Method—Option #3).

8. A woven fabric of claim 1, wherein said woven fabric can dry from a fully wet condition (padded) to less than 1% by weight water in less than about 185 minutes in a controlled environment of 70° F. (+/−2° F.) and 55% relative humidity (+/−5% relative humidity), when tested in accordance with a modified version of the provisional AATCC Gravimetric Drying Test Method (AATCC/ASTM MM TS-05).

9. A woven fabric of claim 1, wherein said woven fabric has a drying time of less than about 105 minutes from 20% by weight water to 1% by weight water in a controlled environment of 70° F. and 55% relative humidity (+/−5% relative humidity), when tested in accordance with a modified version of the provisional AATCC Gravimetric Drying Test Method (AATCC/ASTM MM TS-05).

10. A woven fabric of claim 1, wherein said woven fabric has a basis weight of at least 12.0 ounces/square yard.

11. A woven fabric of claim 1, wherein said warp yarns are dyed indigo.

12. A woven fabric of claim 1, wherein said warp yarns are dyed with a high visibility dye.

13. A woven fabric of claim 1, wherein said hydrophobic fiber is polypropylene, polyethyleneterephthalate, polybutyleneterephthalate, poly(trimethylene terephthalate), polylactide, nylon, polyacrylonitrile, polybenzimidazole, fluoropolymer, a copolymers thereof, or combination thereof.

14. A woven fabric of claim 1, wherein said hydrophobic fiber is modacrylic, nylon, or a combination thereof.

15. A woven fabric of claim 1, wherein said hydrophilic fiber is a cellulose derivative.

16. A woven fabric of claim 15, wherein said hydrophilic fiber is cotton, viscose, linen, rayon, or a combination thereof.

17. A woven fabric of claim 15, wherein said hydrophilic fiber is cotton.

18. A woven fabric of claim 1, wherein said cellulose derivative is cotton.

19. A woven fabric of claim 1, wherein said plurality of warp yarns comprise about 100% by weight, based on the total weight of the warp yarns, of said cellulose derivative.

20. A woven fabric of claim 1, wherein said plurality of warp yarns comprise about 100% by weight, based on the total weight of the warp yarns, of cotton.

21. A woven fabric of claim 1, wherein said weft yarns are formed from:

about 75%, by weight, based on the total weight of the weft yarns, of modacrylic fibers;

about 10%, by weight, based on the total weight of the weft yarns, of nylon fibers; and about 15%, by weight, based on the total weight of the weft yarns, of cotton fibers; and wherein said warp yarns are formed from:

about 100%, by weight, based on the total weight of the warp yarns, of cotton fibers.

22. A woven fabric of claim 1, wherein said weft yarns are present at a level of about 30% to about 70%, by weight, based on the total weight of the woven fabric.

23. A woven fabric of claim 1, wherein said hydrophobic fibers and said hydrophilic fibers in said weft yarns are substantially intimately blended.

24. A woven fabric of claim 1, wherein said fibers in said warp yarns are substantially intimately blended.

25. A woven fabric of claim 1, wherein said woven fabric is a twill fabric having a technical face and a technical back;

wherein said technical face comprises a predominant amount of said warp yarns; and wherein said technical back comprises a predominant amount of said weft yarns.

26. A woven fabric of claim 1, further comprising:

at least one stain release agent or water repellant.

27. A garment, comprising:

said woven fabric of claim 1;

wherein a side of said woven fabric comprising a predominant surface area of said weft yarn is positioned to face towards a wearer's skin.

28. A garment of claim 27,
wherein a side of said woven fabric positioned to face away from a wearer's skin is treated with a stain release agent or water repellant.

29. A garment of claim 27,
wherein said garment is a pant.

30. A garment of claim 27,
wherein said garment is a jacket.

31. A garment of claim 27,
wherein said garment is a shirt.

* * * * *